US006802764B2

(12) United States Patent
Besch

(10) Patent No.: US 6,802,764 B2
(45) Date of Patent: Oct. 12, 2004

(54) POWER TOOL COMPRISING A SECUREMENT FLANGE

(75) Inventor: Hansjoerg Besch, Moessingen (DE)

(73) Assignee: C & E. Fein GmbH & Co. KG (DE)

( * ) Notice: Subject to any disclaimer, the term of this patent is extended or adjusted under 35 U.S.C. 154(b) by 0 days.

(21) Appl. No.: 10/271,866

(22) Filed: Oct. 16, 2002

(65) Prior Publication Data

US 2003/0100251 A1 May 29, 2003

(30) Foreign Application Priority Data

Oct. 16, 2001 (DE) ..... 201 17 159 U

(51) Int. Cl.[7] ..... B24B 41/04

(52) U.S. Cl. ..... 451/344; 451/359; 451/343; 83/651; 30/340; 408/239 V

(58) Field of Search ..... 451/342, 344, 451/359, 343, 352; 83/651, 698.11, 41; 408/239 R; 30/340, 337, 342; 411/402

(56) References Cited

U.S. PATENT DOCUMENTS

| | | | | |
|---|---|---|---|---|
| 4,428,120 A | | 1/1984 | Kobayashi et al. | |
| 4,497,141 A | * | 2/1985 | Jarby | 451/342 |
| 4,507,999 A | * | 4/1985 | Dezern | 83/665 |
| 4,729,193 A | * | 3/1988 | Gant et al. | 451/342 |
| 4,772,201 A | * | 9/1988 | Johnsen et al. | 433/134 |
| 4,976,071 A | * | 12/1990 | Stabler | 451/342 |
| 4,980,976 A | | 1/1991 | Junginger et al. | 30/272.1 |
| 5,031,361 A | * | 7/1991 | MacKay, Jr. | 451/342 |
| 5,279,190 A | * | 1/1994 | Goss et al. | 81/460 |
| 5,303,688 A | | 4/1994 | Chiuminatta et al. | |
| 5,366,312 A | * | 11/1994 | Raines | 403/3 |
| 5,477,845 A | * | 12/1995 | Zuzelo | 125/15 |
| 5,651,726 A | * | 7/1997 | Skogsberg | 451/342 |
| 6,042,461 A | * | 3/2000 | Pearson | 451/359 |
| 6,093,090 A | | 7/2000 | Tosto et al. | |

FOREIGN PATENT DOCUMENTS

| | | |
|---|---|---|
| DE | 197 36 933 | 10/1998 |
| EP | 0 369 390 | 11/1989 |
| EP | 1 213 07 | 6/2002 |

* cited by examiner

*Primary Examiner*—George Nguyen
(74) *Attorney, Agent, or Firm*—St. Onge Steward Johnston & Reens LLC

(57) ABSTRACT

A power tool comprising a drive shaft for driving a tool, a recess at a free end of the drive shaft, and a detachable securement flange having a securement section on a side facing the drive shaft is disclosed. The securement section is form-fitted for insertion into the recess of the drive shaft and comprises a flange section on the opposite side, wherein the tool comprises a respective securement opening which is adapted to the shape of the securement section of the securement flange for form-fit securement of the securement opening of the tool to the securement section.

22 Claims, 2 Drawing Sheets

POWER TOOL COMPRISING A SECUREMENT FLANGE

BACKGROUND OF THE INVENTION

The invention relates to a power tool comprising a drive shaft for driving a tool, wherein on a free end of the drive shaft a support for securing a tool is provided.

Such a power tool is known from EP 0 369 390 A2.

The known power tool comprises an oscillatory drive by means of which a tool secured to the free end of the drive shaft is oscillated with high frequency between roughly 5000 to 25000 oscillations per minute at low pivot angle in the range between 0.5° and 5°. Thus the tool can be oscillated about the longitudinal axis of the drive shaft to perform particular cutting tasks, for instance for cutting adhesive beads on windshield panes, if these have to be exchanged. In addition, there are various possibilities for applications in the field of cutting, sawing, grinding, polishing etc.

From EP 0 369 390 A2 it is known to provide the tool with a securement opening for form-fit securement onto a securement section of the drive shaft and for subsequent fixing by means of a nut that can be screwed onto the end of the drive shaft.

In addition, designs have become known by public use, wherein on a free end of the drive shaft a threaded bore is provided into which a securement screw can be screwed which rests with a screw head of sufficient diameter against the surface of the tool for securing same to the drive shaft.

To obtain a secure power transfer and to ensure a precise alignment of the tool with respect to the work location, a form-fit between the securement opening of the tool and the securement section of the drive shaft is desired.

A drawback in this design has been that a final fixation of the angular location of the tool with respect to the drive shaft can only be reached, when the respective securement nut or the securement screw, respectively, has been sufficiently tightened on the threads of the drive shaft. Only in a final moment, just before the final tightening of the nut or the screw, respectively, the tool will be secured against further rotation.

SUMMARY OF THE INVENTION

It is a first object of the invention to provide an improved power tool allowing a positive fit of a tool to a drive shaft of the power tool at an early time of the securement operation already, preferably already when positioning on the free end of the drive shaft.

It is a further object of the invention to disclose a power tool allowing a positive fit of a tool to a drive shaft of the power tool in various ways.

It is a further object of the invention to disclose an adapter for form-fit securement of a tool to a free end of a drive shaft of a power tool.

It is still a further object of the invention to disclose a drive shaft for a power tool suitable form form-fit securement of a tool by means of an adapter.

These and other objects of the invention are achieved by a power tool comprising a drive shaft for driving a tool, a recess at a free end of the drive shaft, a detachable securement flange having a securement section on a side facing the drive shaft, the securement section being form-fitted for insertion into the recess of the drive shaft and comprising a flange section on the opposite side, wherein the tool comprises a securement opening which is adapted to the shape of the securement section of the securement flange for form-fit securement of the securement opening of the tool to the securement section, when the latter protrudes from the outside to the securement opening into the recess of the drive shaft.

By contrast to a raised securement section at the free end of the drive shaft now a recess is provided on the free end of the drive shaft. All in all, the tool is form-fitted to the drive shaft by means of a securement flange which positively engages with the securement opening of the tool and which is form-fitted for insertion into the recess on the free end of the drive shaft. According to the invention, it is not necessary to tighten a screw or a nut first, until finally a form-fit, and thereby also a protection against angular rotation, is reached.

By contrast, the tool can be applied together with the securement flange onto the drive shaft and is immediately held form-fitted on the drive shaft by means of the securement flange, while thereafter a securing element, for instance a screw, is used to finally fix the tool in this position on the drive shaft.

To this end according to a preferred development of the invention a threaded hole for receiving a securement screw is provided on the drive shaft. The securement flange in this embodiment is penetrated by an opening for receiving the securement screw.

Thus the tool can initially be placed on the drive shaft together with the securement flange and can be form-fit secured, while thereafter the securement screw is introduced through the opening of the securement flange and is screwed into the threaded hole, to thus fix the tool to the drive shaft.

According to a further embodiment of the invention, the securement section of the securement flange comprises a uniform cross section for form-fit support in the recess of the drive shaft as well as for form-fit support in the securement opening.

Such a design is preferred when the form of the securement opening of the tool and the recess on the free end of the drive shaft are identical. In this case the securement section of the drive shaft having a uniform cross section can positively engage with the securement opening of the tool as well as with the securement opening at the free end of the drive shaft.

According to an alternative embodiment of the invention the securement section comprises a first region being adapted for form-fit support in the recess of the drive shaft, and further comprises a second region adapted for form-fit support in the securement opening, wherein the first and second regions are of different configuration.

Such a design is suitable, when the shape of the securement opening of the tool differs from the recess at the free end of the drive shaft and is not compatible therewith. In this case the two regions of the securement section of the securement flange can be adapted accordingly, to obtain a form-fit with the securement opening of the tool, as well as with the recess at the free end of the drive shaft.

In this case the securement flange simultaneously functions as an adapter between different shapes of the securement section of the tool on the one hand and the recess at the free end of the drive shaft on the other hand.

In a preferred development of the invention the securement flange comprises an enlargement for receiving a screw head at least partially recessed at the side facing away from the power tool.

In this way a securement screw which is utilized for securing the securement flange and the tool to the drive shaft, is received recessed or at least partially recessed on the securement flange, which allows an advantageous operation.

The recess at the free end of the drive shaft may be formed as a regular polygon, preferably as a hexagon.

In this case a continuous securement section on the securement flange together with a polygon shape matched thereto can be utilized for form-fit securement of the securement opening as well as of the recess to the free end of the drive shaft. Herein, the tool, such as known in the prior art, may comprise a securement opening in the shape of a dodecagon according to EP 0 369 390 A2, wherein between two adjacent outer corners always an inner corner displaced to the inside is formed, so that generally a star-shape results. Such a securement opening may for instance be form-fit secured by means of a continuous securement section in the shape of a hexagon, to the free end of the drive shaft.

According to an advantageous improvement of the invention in this design the corner regions of the polygonal recess at the free end of the drive shaft are enlarged to the outside by rounded sections.

Thereby a cramming of the securement section of the securement flange in the recess of the drive shaft is avoided. Also manufacture is simplified.

It will be understood that the recess of the drive shaft, the securement section of the securement flange and the securement opening of the tool can also be of any other desired shape, if the respective shapes are respectively adapted to each other.

Thus it is conceivable for instance to provide at the free end of the drive shaft a plurality of recesses at predetermined locations for receiving protrusions of the securement flange.

According to another embodiment of the invention the recess comprises a plurality of preferably six rounded tips which are located in regular angular intervals with respect to each other at a radial distance to the longitudinal axis of the drive shaft, wherein each pair of adjacent tips is connected by curved sections which bulge out from the adjacent tips into the direction of the longitudinal axis and coincide in a common summit.

Such a shape has particular advantages for obtaining a uniform torque transmission also at high load. Since there are no sharp-edged tips and since power transmission is obtained primarily by means of the curved sections between the rounded tips, punctual loads and high surface pressures are avoided, whereby a wear-out of the form-fit connection can be safely avoided, also after long usage.

Of course, if desired, also this shape may be combined with other shapes, if for instance the tool comprises a securement opening of different shape. Reversely, also a tool with a securement section of such a shape can be secured at the free end of the drive shaft by means of the securement flange, if the latter comprises suitably adapted regions at its securement section.

According to an alternative embodiment the object of the invention is achieved by a power tool comprising a drive shaft for driving a tool, an raised securement section at a free end of the drive shaft, a detachable securement flange having a securement opening on a side facing the drive shaft, the securement section being form-fitted for attachment onto the securement section, wherein the tool comprises a securement opening which is form-fitted to the shape of the securement section.

Also in this way the object of the invention is solved completely. This is a modification according to which on the drive shaft an embossed section is provided, whereon the tool can be supported with its securement opening form-fittedly, wherein the securement flange comprises a respective recess for form-fit engagement with the securement section of the drive shaft.

It will be understood that the above-mentioned and following features of the invention are not limited to the given combinations, but are applicable in other combinations or taken alone without departing from the scope of the invention.

BRIEF DESCRIPTION OF THE DRAWINGS

Further features and advantages of the invention will become apparent from the following description of preferred embodiments taken in conjunction with the drawings. In the drawings.

DETAILED DESCRIPTION OF THE PREFERRED EMBODIMENTS

Figure 1:
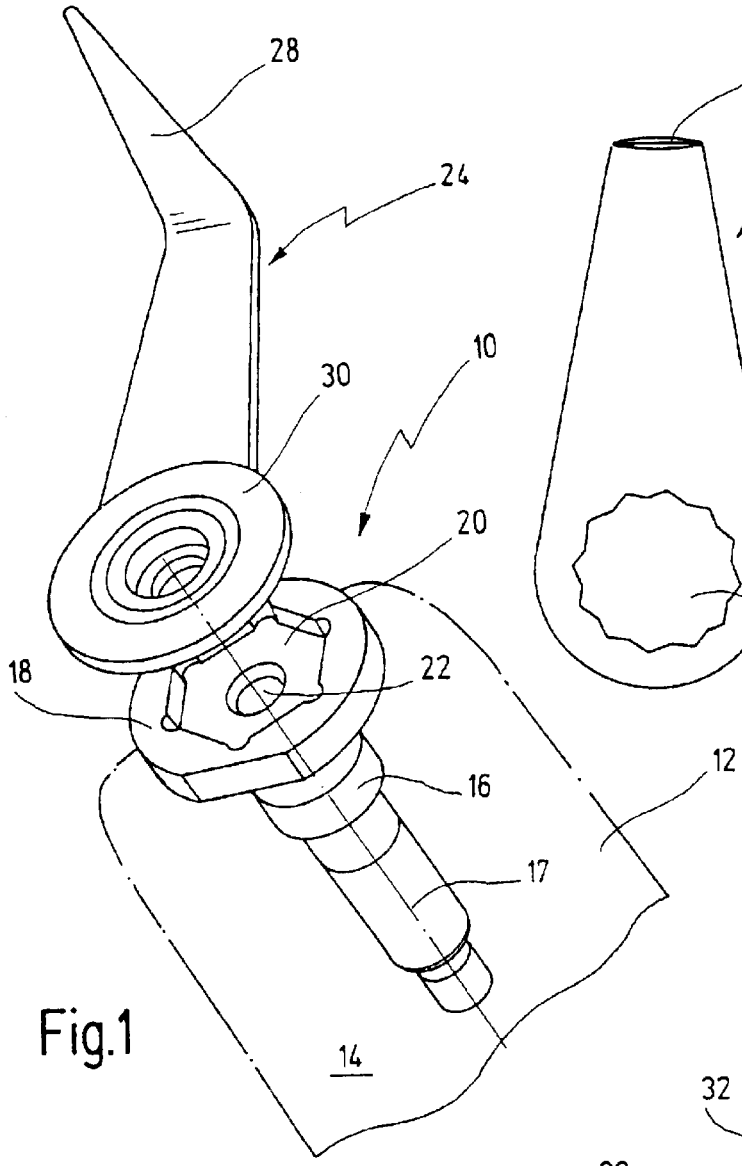
FIG. 1 is an explosive view of a drive shaft according to the invention shown together with a tool at a distance therefrom, onto the securement opening of which a securement flange is received, before the unit formed in this way can be placed in a recess at a free end of the drive shaft.

In FIG. 1 a power tool is shown merely schematically with a dash-dotted line and is designated in total with numeral 10. The power tool 10 comprises a housing 12 within which an electric motor is received that oscillatingly drives, by means of a suitable gear, a drive shaft 16 about its longitudinal axis 17 at a high-frequency in the range of roughly 5000 to 25000 oscillations per minute and at a small pivot angle in the range of roughly 0.5 to 5°. The electric motor and the respective oscillatory gear together form a drive which is not shown in FIG. 1 in detail and which is schematically depicted with numeral 14. The drive shaft 16 protrudes with its free end from the housing 12, wherein the free end is formed as a securement flange 18. Within the securement flange 18 a securement opening 20 of hexagonal shape, which will subsequently be explained, is located recessed. In addition, the drive shaft 16 comprises a threaded hole 22 which is adapted for receiving a securement screw. In FIG. 1 a tool 24 is shown at a distance from the drive shaft 16, the tool in the case shown being a cutting knife that can be used in combination with the oscillatory drive 14 of the power tool 10 for cutting the adhesive beads on panes, such as windscreens of automobiles. The tool 24 according to FIG. 2 at one end comprises a bihexagonal securement opening 26, wherein additionally between respective adjacent outer corners an inner corner displaced to the inside is formed, so that a generally star-shaped securement opening 26 results. At the end opposite the securement opening 26 the tool 24 comprises an orthogonally protruding cutting part 28 that is sharpened on both side edges and that transitions into a common tip.

For securing this tool 24 to the drive shaft 16 a securement flange 30 is provided which protrudes through the securement opening 26 with a suitably formed securement section and that can be inserted form-fitted into the recess 20 of the drive shaft. Thus the securement flange 30 can be inserted with its securement section through the securement opening 26 and can engage with the recess 20 of the drive shaft 16, so that all in all the tool 24 via the securement flange 30 positively engages with the drive shaft 16, as will be discussed hereinafter in more detail.

Figure 3:
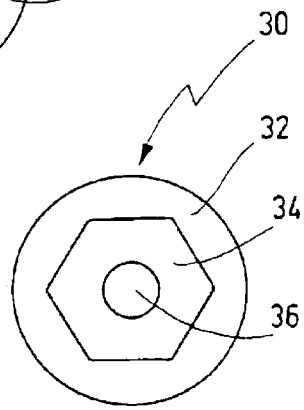
FIG. 3 is a view of the securement flange according to FIG. 1, seen from the drive shaft.
Figure 4:
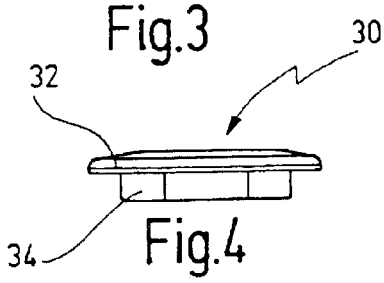
FIG. 4 is a side view of the securement flange according to FIG. 3.
Figure 5:
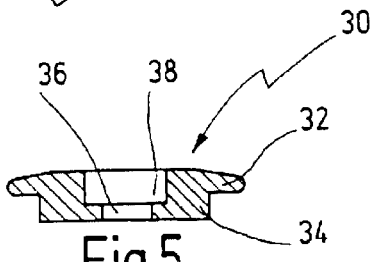
FIG. 5 is a cross section of the securement flange according to FIG. 3.

The shape of the securement flange 30 can be seen from FIGS. 3 through 5. At a side facing the drive shaft 16, the securement flange 30 comprises a securement section 34 that is hexagonally shaped and that, naturally, is adapted by its afore-mentioned dimension to the recess 20 at the end of the drive shaft 16. The securement section 34 ends in a flange section 32 which protrudes from the securement section 34 to the outside and thus forms a rest surface for resting against the tool 24. The securement flange 30 is penetrated by a central opening 36 which, at its side facing away from the drive shaft 16, is provided with an enlargement 38, so that the screw can be inserted with its shaft through the opening 36 and can be received with its head in the enlargement 38 in a sunk-in manner.

Figure 7:
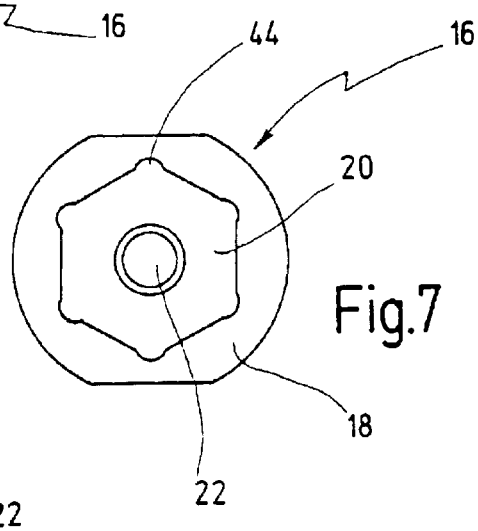
FIG. 7 is a view of the drive shaft, seen from the outside.

The shape of the hexagonal recess 20 in the support flange 18 of the drive shaft 16 can be seen from FIG. 7 in more detail. The recess 20 is shaped hexagonally, however, has rounded corner regions 44, the shape of which can be seen in more detail from FIG. 7. These rounded enlargements of the corners to the outside avoid that the securement flange gets stuck with its securement section 34 in the recess 20 after longer usage, so that it can only be withdrawn by means of a tool. Also this shape can be manufactured more simply.

Figure 6:
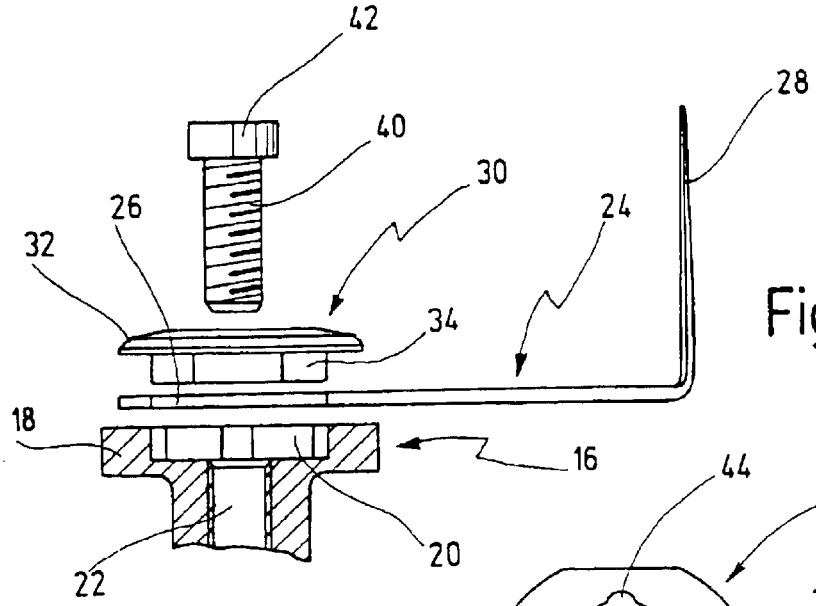
FIG. 6 is an assembly of securement screw, securement flange, tool and drive shaft in a mounting position, at a distance from each other.

In FIG. 6 the securement of the tool 24 by means of the securement flange 30 and the securement screw 40 is shown schematically.

First the securement flange 30 is inserted with its securement section 34 through the securement opening 26, so that the securement flange 30 rests with its flange section 32 against the surface of the tool 24. The unit formed thereby is inserted with the part of the securement section 34 protruding from the tool 24 into the recess 20 at the support flange 18 of the drive shaft 16. If necessary, simultaneously also the angular arrangement of the tool 24 with respect to the drive shaft 16 can be corrected. Thereafter, the securement screw 40 is inserted through the opening 36 of the securement flange 30 and is screwed into the threaded hole 22, until the tool 24 is safely fixed to the securement flange 30. For operating the screw, within the head 42 of the screw a hexagonal socket (not shown) is provided.

Several modifications of the shape of the securement section and of the recess of the support flange of the drive shaft, respectively, are in the following discussed with reference to FIGS. 8, 9 and 10.

Herein for similar parts the same reference numerals are used.

Figure 8:
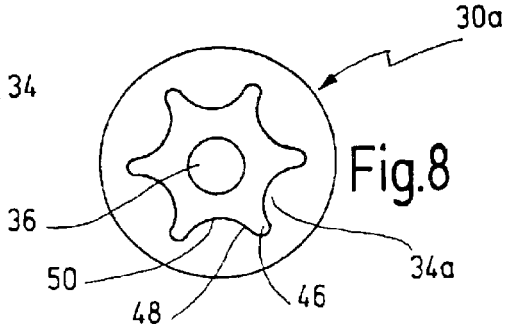
FIG. 8 is a modified embodiment of the securement flange, seen from the drive shaft.

FIG. 8 shows a modified securement flange 30*a*, seen from the drive shaft 16. The only difference with respect to the securement flange 30 explained before with reference to FIG. 3 results from a modified shape of the securement section 34*a*. The securement section 34*a* comprises six rounded tips 46, arranged in regular angular intervals of 60° with respect to each other, wherein each pair of adjacent tips 46 is connected by curved sections or flanks 48 that bulge out into the direction of the center of the opening 36 and that coincide in a common summit 50. In this way a regular polygon with six rounded tips is formed that are each connected by means of curved sections 48 bulging out toward the center.

Such a shape is advantageous for a uniform torque transmission and avoids a wear-out of the form-fit engagement, since there are no sharp-edged corner regions etc.

In the case shown, the recess 20 of the drive shaft 16 as well as the securement opening 26 are mated to the shape of the securement section 34*a*, so that, as previously explained with reference to FIG. 6, the tool can be positively secured to the support flange 18 of the drive shaft 16 by means of the securement flange 30*a* and the securement screw.

Figure 9:
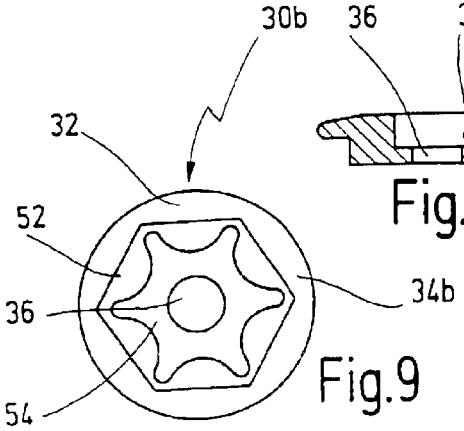
FIG. 9 is a further modification of the securement flange, seen from the drive shaft.

A modified embodiment of the securement flange is shown in FIG. 9 and depicted in total with numeral 30*b*. In the side view from the drive shaft it can be seen that the securement section 34*b* of the securement flange 30*b* comprises two regions, namely a first region 54 having a hexagonal outer shape, which is followed into the direction of the drive shaft 16 by a second region 52, the cross section of which corresponds to the cross section of the securement section 34*a* according to FIG. 8.

Figure 2:
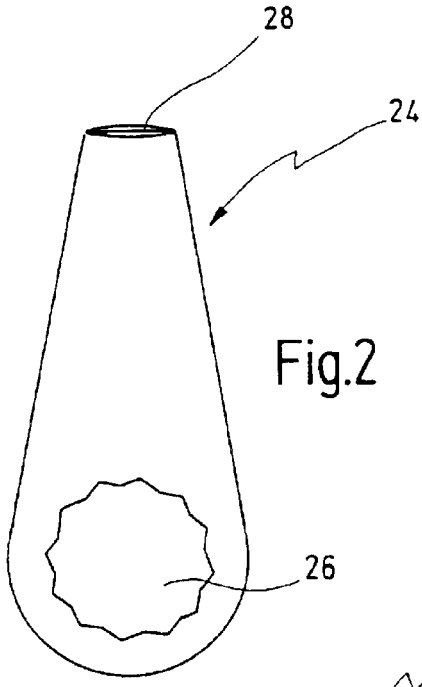
FIG. 2 depicts a view of the tool according to FIG. 1, seen from the top.

This now makes possible to secure a tool 24 having a star-shaped securement opening 26 according to FIG. 2 by means of a securement flange 30*b* to a drive shaft, the recess 20 of which has a shape corresponding to the polygonal shape according to FIG. 8.

In this case the securement flange 30*b* simultaneously functions as an adapter for different shapes of the securement opening 26 and the recess at the support flange of the drive shaft.

Figure 10:
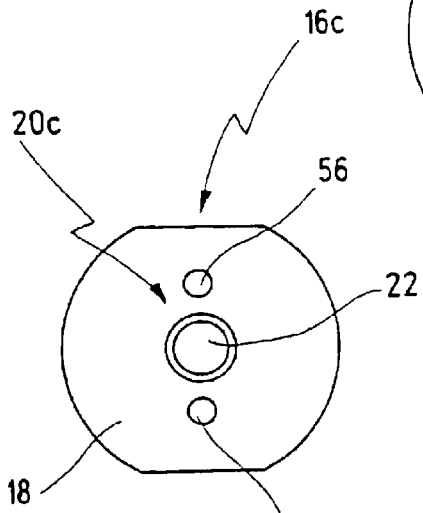
FIG. 10 is a modification of the drive shaft, in a side view from the outside.

Another embodiment is shown in FIG. 10. FIG. 10 merely shows the side view of a modified drive shaft 16*c*, seen from the outside. It shall be understood that the shape of the securement section of the respective securement flange is adapted accordingly. The recess 20*c* which is provided in the support flange 18 of the drive shaft 16*c*, in the case shown is formed by two cylinder-shaped recesses 56, 58 that are arranged at equal distance from the threaded hole 22 of the support flange 18 angularly displaced at equal distances of 180° with respect to each other.

Figure 11:
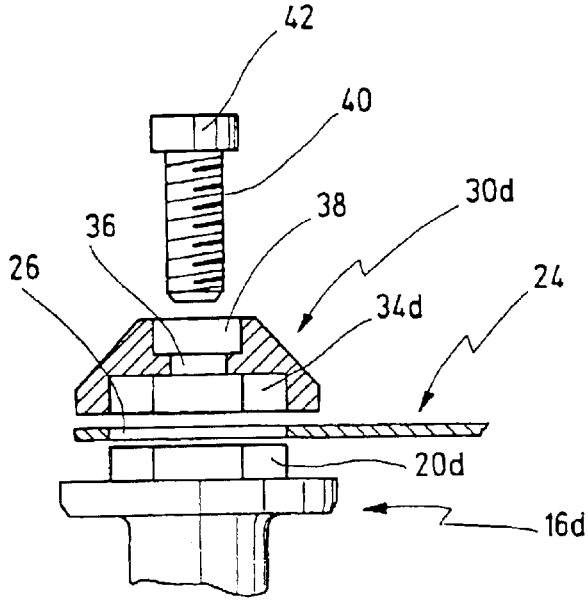
FIG. 11 is a further modification of the invention, shown in an assembly of securement flange, tool and drive shaft in a mounting position, at a distance from each other.

Another modification of the invention is shown in FIG. 11. Herein on a drive shaft 16*d* an embossed securement section 20*d* is formed in the shape of a hexagon onto which the tool 24 can be placed with its securement opening 26 in a form-fitted manner. A securement flange 30*d* assigned thereto comprises a mated securement opening 34*d* which also forms a form-fit with the securement section 20*d*. For securement again a screw is used that can be screwed through an opening 36 of the securement flange 30*d* into a threaded hole of the drive shaft 16*d*, and which is received with its head 42 recessed in an enlargement 38 of the opening 36.

It shall be understood that these embodiments are only a small selection of the various embodiments of the shapes of the recess 20 at the free end of the drive shaft 16 and the respective support flange 30 as well as of the shapes of the securement opening of the tool 24, and that further modifications are possible within the scope of the present invention.

What is claimed is:

1. A power tool comprising:

a drive shaft for driving a tool;

a recess provided at a free end of said drive shaft and having a wall;

a detachable securement flange having a securement section on a first side facing the drive shaft, the securement section having a wall and being form-fitted for insertion into the recess of the drive shaft;

said wall of said recess is adapted to receive a compressive force from said wall of said securement section;

said wall of said securement section is adapted to receive a compressive force from said wall of said recess; and a securement opening provided on said tool and being mated to the shape of said securement section of said securement flange for form-fit securement of said tool to said drive shaft, when said securement section of said flange engages said securement opening of said tool and said recess of said drive shaft.

2. The power tool of claim 1, wherein said drive shaft further comprises a threaded hole for receiving a securement screw, and wherein said securement comprises an opening for inserting said securement screw through said opening into said threaded hole.

3. The power tool of claim 1, wherein said securement section of said securement flange comprises a uniform cross section allowing to positively engage said recess of said drive shaft as well as said securement opening.

4. The power tool of claim 1, wherein said opening of said securement flange at a side facing away from the power tool, comprises an enlargement for receiving a screw head at least partially recessed.

5. A power tool comprising:

a drive shaft for driving a tool;

a recess provided at a free end of said drive shaft;

a detachable securement flange having a securement section on a first side facing the drive shaft, the securement section being form-fitted for insertion into the recess of the drive shaft;

a securement opening provided on said tool and being mated to the shape of said securement section of said securement flange for form-fit securement of said tool to said drive shaft, when said securement section of said flange engages said securement opening of said tool and said recess of said drive shaft; and said securement section of said securement flange comprises a first region being mated to the recess of said drive shaft for positive engagement therewith, and wherein said securement section further comprises a second region being mated to said securement opening for positive engagement therewith, wherein said first and second regions are of different configuration.

6. The power tool of claim 5, wherein said recess at the free end of said drive shaft is shaped as a regular polygon.

7. The power tool of claim 6, wherein said recess at the free end of said drive shaft is shaped as a hexagon.

8. The power tool of claim 6, wherein said recess comprises six corners which are extended to the outside by rounded sections.

9. The power tool of claim 5, wherein said recess of said drive shaft comprises a plurality of rounded tips, which are located radially distant from a longitudinal axis of said drive shaft at regular angular intervals to each other, wherein each pair of adjacent tips is connected by curved flanks bulging out from the adjacent tips toward said longitudinal axis and coinciding in a common summit.

10. The power tool of claim 5, wherein said recess of said securement flange comprises a plurality of deepenings provided at predetermined locations and cooperating with said securement flange for receiving mated protrusions of said securement flange therein.

11. A drive shaft in a power tool, comprising a recess at a free end of said drive shaft, the recess being mated to a securement section of a detachable securement flange to provide a form-fit securement of a tool to said drive shaft when said securement flange positively engages said recess of said drive shaft and a securement opening of said tool, wherein said form-fit securement inhibits angular rotation between said recess and said securement section.

12. A securement flange for form-fit securement of a tool to a free end of a drive shaft of a power tool, said flange comprising:

a securement section, the outer contour of which is mated to an inner contour of a securement opening of said tool and to a recess provided at said free end of said drive shaft, thereby allowing a form-fit between said securement opening of said tool, said securement flange and said recess of said drive shaft;

the recess having a wall;

the securement section having a wall;

said wall of said recess is adapted to receive a compressive force from said wall of said securement section; and said wall of said securement section is adapted to receive a compressive force from said wall of said recess.

13. The securement flange of claim 12, wherein said securement flange further comprises a flange section protruding from the securement section to the outside, said flange section acting as a stop resting against a surface of said tool.

14. The securement flange of claim 12, further comprising an opening for receiving a securement screw.

15. The securement flange of claim 12, wherein said opening, at the side facing away from the power tool, further comprises an enlargement for receiving a screw head at least partially recessed.

16. A securement flange for form-fit securement of a tool to a free end of a drive shaft of a power tool, said flange comprising:

a securement section, the outer contour of which is mated to an inner contour of a securement opening of said tool and to a recess provided at said free end of said drive shaft, thereby allowing a form-fit between said securement opening of said tool, said securement flange and said recess of said drive shaft; and wherein said securement section comprises a first region being form-fitted to said recess of said drive shaft, and wherein said securement section further comprises a second region being form-fitted to said securement opening of said tool.

17. The securement flange of claim 16, wherein said first and second regions are shaped differently.

18. The securement flange of claim 16, wherein said first and second regions have identical cross sections.

19. The securement flange of claim 16, wherein at least one of said first and second regions of said securement section is shaped as a regular polygon.

20. The securement flange of claim 19, wherein at least one of said first and second regions of said securement section is shaped as a hexagon.

21. The securement flange of claim 16, wherein at least one of said first and second regions of said securement section comprises a plurality of rounded tips which are located radially distant from a longitudinal axis of said drive shaft at regular angular intervals to each other, wherein each pair of adjacent tips is connected by curved flanks bulging out from the adjacent tips toward said longitudinal axis and coinciding in a common summit.

22. The securement flange of claim 16, wherein at least one of said first and second regions of said securement section comprises a plurality of protrusions arranged at predetermined locations which are form-fitted to respective deepenings provided on said drive shaft.

* * * * *